US008769755B2

(12) United States Patent
Hetler

(10) Patent No.: US 8,769,755 B2
(45) Date of Patent: Jul. 8, 2014

(54) SIDE BRUSH ASSEMBLY MECHANISM

(75) Inventor: Matthew R. Hetler, Crystal, MN (US)

(73) Assignee: Tennant Company, Minneapolis, MN (US)

( * ) Notice: Subject to any disclaimer, the term of this patent is extended or adjusted under 35 U.S.C. 154(b) by 335 days.

(21) Appl. No.: 12/942,683

(22) Filed: Nov. 9, 2010

(65) Prior Publication Data

US 2011/0107529 A1 May 12, 2011

Related U.S. Application Data

(60) Provisional application No. 61/259,580, filed on Nov. 9, 2009.

(51) Int. Cl.
*E01H 1/04* (2006.01)

(52) U.S. Cl.
USPC ..... 15/49.1; 15/52.1; 15/82; 15/87

(58) Field of Classification Search
USPC ..... 15/49.1, 52.1, 79.1, 79.2, 82, 87
See application file for complete search history.

(56) References Cited

U.S. PATENT DOCUMENTS

| | | | | | |
|---|---|---|---|---|---|
| 2,655,678 | A | * | 10/1953 | Keogh | 15/87 |
| 2,950,827 | A | * | 8/1960 | Burgdorff | 414/528 |
| 2,972,159 | A | * | 2/1961 | Kimmerle et al. | 15/340.4 |
| 2,996,742 | A | * | 8/1961 | Aimers et al. | 15/87 |
| 3,024,485 | A | | 3/1962 | Schmidt | |
| 3,037,226 | A | * | 6/1962 | Schmidt et al. | 15/82 |
| 3,186,016 | A | * | 6/1965 | Gehman et al. | 15/85 |
| 3,292,195 | A | * | 12/1966 | Schmidt et al. | 15/87 |
| 3,316,578 | A | * | 5/1967 | Tamny | 15/87 |
| 3,459,109 | A | * | 8/1969 | Ingleright | 404/87 |
| 3,616,477 | A | * | 11/1971 | Larson | 15/82 |
| 3,790,981 | A | * | 2/1974 | Young | 15/87 |
| 3,825,968 | A | * | 7/1974 | Larsen | 15/87 |
| 3,886,623 | A | * | 6/1975 | Landesman et al. | 15/319 |
| 4,335,482 | A | * | 6/1982 | Jones | 15/87 |
| 4,368,554 | A | * | 1/1983 | Mealing et al. | 15/354 |
| 4,490,874 | A | * | 1/1985 | Duncan | 15/87 |
| 4,492,002 | A | * | 1/1985 | Waldhauser et al. | 15/320 |
| 4,557,010 | A | * | 12/1985 | Rosseau | 15/83 |
| 4,691,402 | A | * | 9/1987 | Veselka | 15/87 |
| 4,754,521 | A | * | 7/1988 | Zoni | 15/340.1 |
| 4,831,684 | A | * | 5/1989 | Duncan | 15/340.1 |
| 5,720,890 | A | | 2/1998 | Caliva | |
| 5,802,665 | A | * | 9/1998 | Knowlton et al. | 15/340.4 |
| 5,987,699 | A | * | 11/1999 | Nakamura et al. | 15/349 |
| 6,675,424 | B2 | * | 1/2004 | Smith et al. | 15/87 |
| 6,836,919 | B2 | * | 1/2005 | Shinler | 15/78 |
| 7,313,839 | B2 | * | 1/2008 | Shinler | 15/49.1 |
| 7,441,303 | B2 | * | 10/2008 | Adair et al. | 15/340.3 |

(Continued)

OTHER PUBLICATIONS

International Search Report and Written Opinion for PCT/US2010/056003 mailed Jan. 10, 2011.

*Primary Examiner* — Monica Carter
*Assistant Examiner* — Michael Jennings
(74) *Attorney, Agent, or Firm* — Briggs and Morgan, P.A.

(57) ABSTRACT

A side brush assembly mechanism for a floor surface maintenance vehicle including a linkage assembly supporting a brush deck, a pivot assembly and a cable connected to the linkage assembly, and a cable tensioning device for retracting the cable. The cable tensioning device is capable of lifting and retracting the brush deck. The side brush assembly mechanism may include a biasing mechanism for lowering and extending the brush deck.

21 Claims, 20 Drawing Sheets

(56) References Cited

U.S. PATENT DOCUMENTS

| | | | | |
|---|---|---|---|---|
| 8,079,107 | B2 * | 12/2011 | Katenhusen et al. | 15/50.3 |
| 8,136,193 | B2 * | 3/2012 | Larkowski et al. | 15/87 |
| 2002/0170130 | A1 * | 11/2002 | Shinler | 15/49.1 |
| 2002/0179116 | A1 * | 12/2002 | Shinler | 134/6 |
| 2004/0045581 | A1 * | 3/2004 | Boomgaarden et al. | 134/6 |
| 2005/0102778 | A1 * | 5/2005 | Gregerson | 15/82 |
| 2010/0325824 | A1 * | 12/2010 | Baum et al. | 15/87 |

* cited by examiner

SIDE BRUSH ASSEMBLY MECHANISM

RELATED APPLICATIONS

This application claims the benefit of U.S. Provisional application No. 61/259,580, filed Nov. 9, 2009, and incorporated herein by reference.

FIELD OF THE INVENTION

The present invention generally relates to floor surface cleaning equipment. More particularly the present invention relates to a side brush assembly mechanism having an extension/retraction/pivot mechanism for use with such equipment.

BACKGROUND OF THE INVENTION

Surface maintenance vehicles and cleaning devices have a long history subject to gradual innovation and improvement toward improved and oftentimes automated performance in removing debris and contamination from floors. These vehicles and devices may be self-powered, towed, or pushed, and/or manually powered and may carry a human operator during cleaning operations. Such vehicles and devices include scrubbers, extractors, sweepers and vacuums, as well as combinations thereof, intended for cleaning, scrubbing, wiping and/or drying a portion of a substantially flat surface both indoors and outdoors. Many such vehicles and devices employ a side brush assembly for accessing a larger floor envelope. Such side brush assemblies make it easier to clean near walls or other obstacles without damaging the machine or the wall while at the same time widening the cleaning path of the machine to increase productivity (area cleaned/time).

The side brush assembly of such prior art cleaning vehicles often mounts at or near the side of a surface maintenance vehicle and swings outwardly away from a machine center and downwardly toward the surface to be cleaned. Prior art side brush assembly mechanisms have included separate actuators or linkages to lift the side brush assembly and rotate the side brush assembly inwardly or outwardly. Some prior art cleaning vehicles have included side brush mechanisms that provide only a lift motion, such as the side brush mechanism of surface cleaning machine model 530E, manufactured by Tennant Company, of Minneapolis, Minn., while other machines have used two separate mechanisms to control lifting and retracting, such as those provided on machine models 528, 7400, M20, T20, and M30, manufactured by Tennant Company.

A lift motion of the side brush assembly is desired to raise the brush deck to provide ground clearance when the scrubbing functions are turned off. An extension/retraction motion is desired to extend the deck past the machine envelope when operating, and to retract the deck back when not operating the side brush. Portions of the side brush assembly retracted behind the machine frame are protected from damage.

Thus, there is a need for an improved side brush assembly mechanism which provides both lift motion and extend/retract motion.

SUMMARY OF THE INVENTION

The present invention teaches, enables and discloses an improved side brush assembly mechanism usable in a floor surface maintenance vehicle. Such a vehicle includes those self-powered and manually-powered cleaning vehicles applied to the task of removing debris and/or cleaning solution from a floor surface. Such a surface may comprise an interior or exterior floor having some limited porosity but preferably comprising finished concrete (whether painted or sealed), asphalt, ceramic tile, resin-based tile, and the like and including most types of flooring typical of commercial and industrial-grade facilities.

One object of the present invention is to provide a side brush assembly mechanism capable of lifting and retracting the brush deck with a single force generator. In one embodiment of the present invention the force generator is an electric linear actuator developing a tension force on a retractor cable.

Another object of the invention is the provision of a side brush assembly mechanism having a biasing mechanism for lowering and extending the brush deck. In one embodiment of the present invention springs are used to provide such biasing forces. In one embodiment of the present invention a combination of torsion and air springs are used to lower and extend the brush deck.

The foregoing has outlined rather broadly the features and technical advantages of the present invention in order that the detailed description of the invention that follows may be better understood. Additional features and advantages of the invention will be described hereinafter which form the subject of the claims of the invention. It should be appreciated by those skilled in the art that the conception and specific embodiment disclosed may be readily utilized as a basis for modifying or designing other structures for carrying out the same purposes of the present invention. It should also be realized by those skilled in the art that such equivalent constructions do not depart from the spirit and scope of the invention as set forth in the appended claims. The novel features which are believed to be characteristic of the invention, both as to its organization and method of operation, together with further objects and advantages will be better understood from the following description when considered in connection with the accompanying figures. It is to be expressly understood, however, that each of the figures is provided for the purpose of illustration and description only and is not intended as a definition of the limits of the present invention.

DETAILED DESCRIPTION OF THE DRAWINGS

Figure 21:
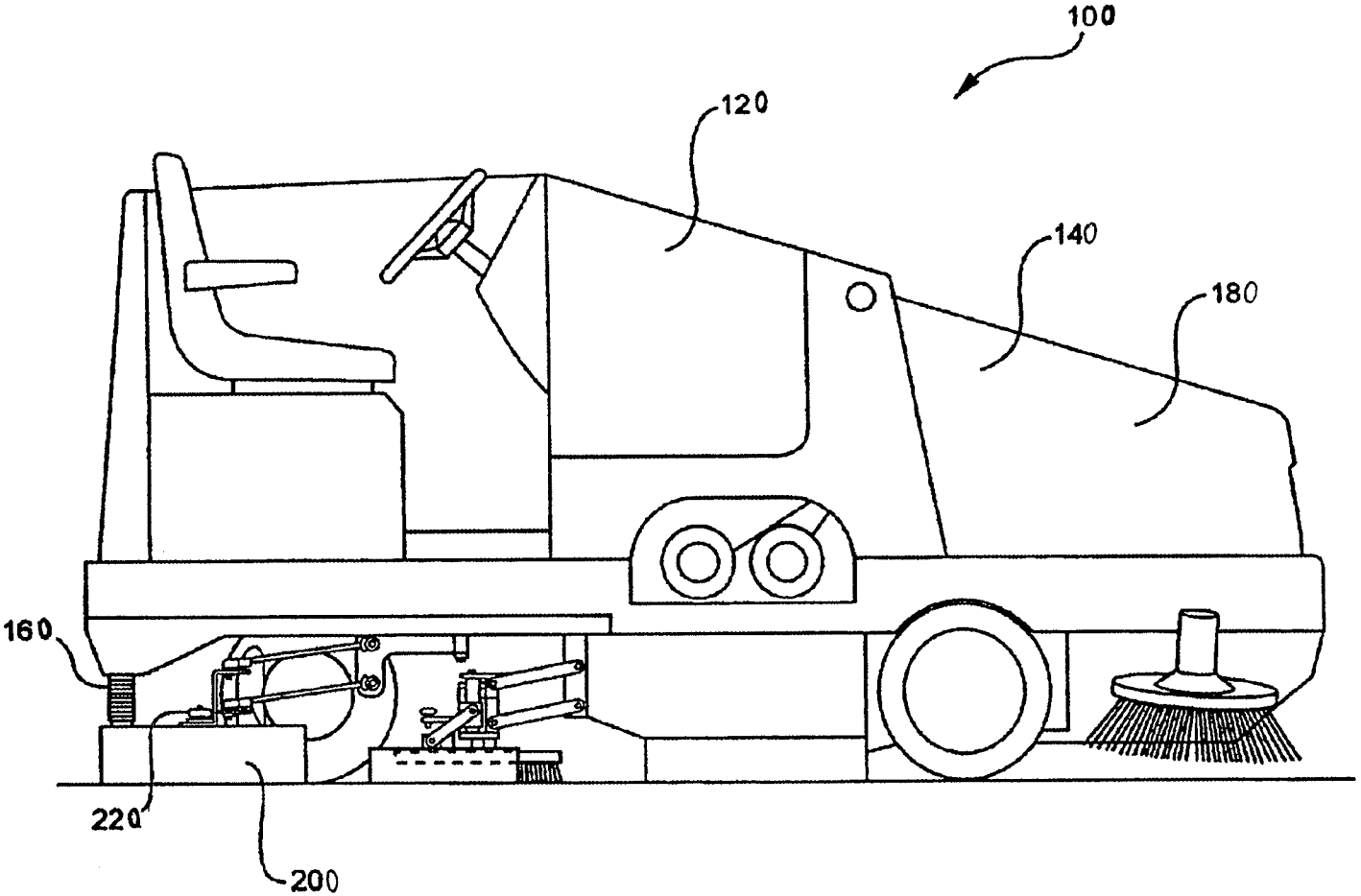
FIG. 21 is a depiction of a ride-on type surface maintenance machine utilizing a squeegee assembly of the present invention.
Figure 22:
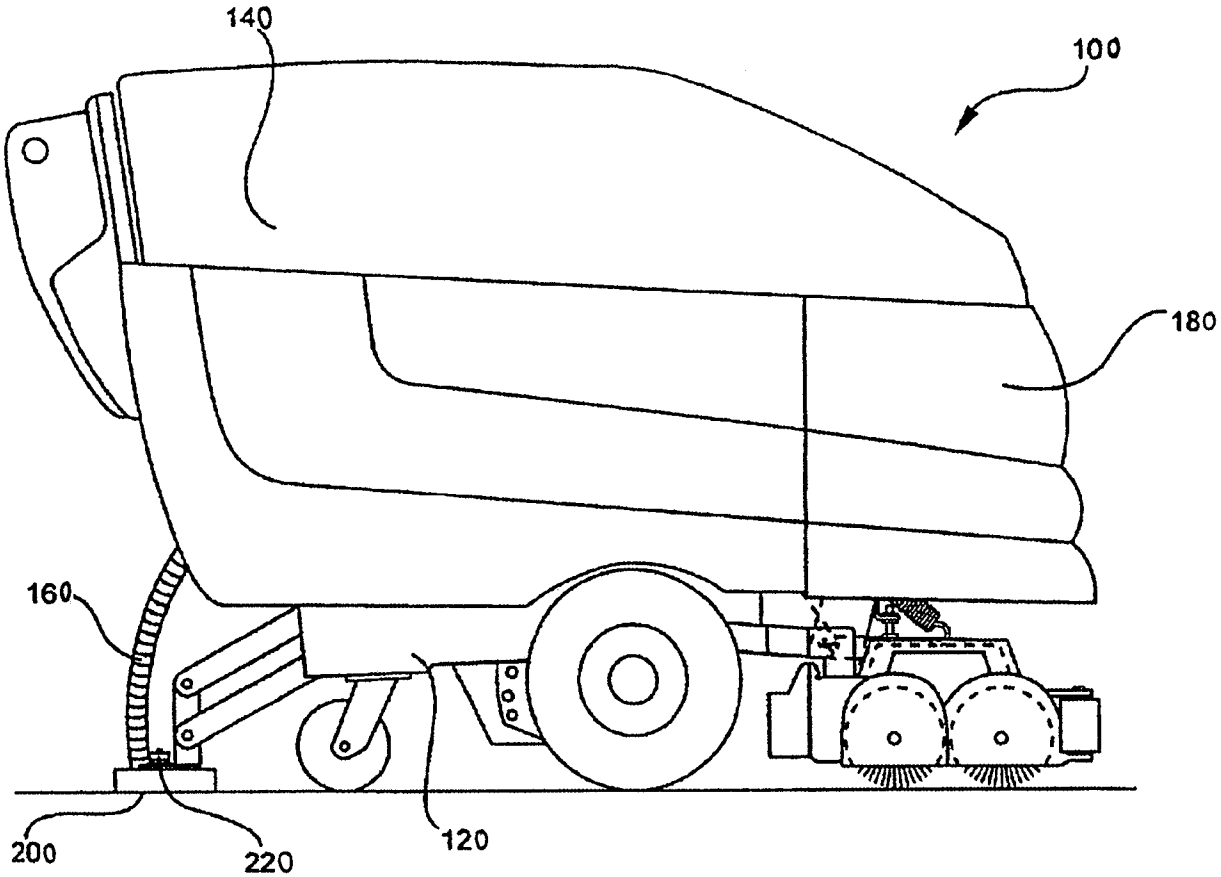
FIG. 22 is a depiction of a walk-behind type surface maintenance machine utilizing a squeegee assembly of the present invention.

Examples of industrial sweeper-scrubbers which may use the present invention are shown in FIGS. 21 and 22. These surface maintenance machines may be used for sweeping and/or scrubbing floors in factories, warehouses, and other industrial or commercial establishments. As shown in FIG. 21, a riding-type surface maintenance vehicle 100 has a frame 120, and is supported on a plurality of front and rear wheels. Typically, such a surface maintenance vehicle 100 includes a variety of implements such as brushes and systems for dispensing cleaning solutions typically composed of detergent and water which suspend dirt. Vehicle 100 includes a vacuum system including a vacuum fan 140, and a vacuum hose 160 in fluid communication with a recovery tank 180. Loaded cleaning solution and other liquid material are usually removed by squeegee assembly 200. Squeegee assembly 200 is mechanically coupled near the rear of a surface maintenance vehicle 100. One example of such a surface maintenance vehicle is disclosed in U.S. Pat. No. 5,455,985, incorporated in its entirety by reference herein.

Alternatively, FIG. 22 illustrates a walk-behind surface maintenance vehicle, such as a floor scrubbing vehicle disclosed in U.S. Pat. No. 5,483,718, incorporated herein by reference in its entirety. As with the above-mentioned riding-type surface maintenance vehicle, the walk behind surface maintenance vehicle 100 includes a variety of implements such as brushes and is capable of applying cleaning solutions. Vehicle 100 includes a vacuum fan 140, a recovery tank 180, and a vacuum conduit 160 providing fluid communication between squeegee assembly 200 and recovery tank 180. Again, loaded cleaning solution and other liquid material are usually removed by an articulated squeegee assembly 200 located at the rear of the surface maintenance vehicle 100.

Figure 1:
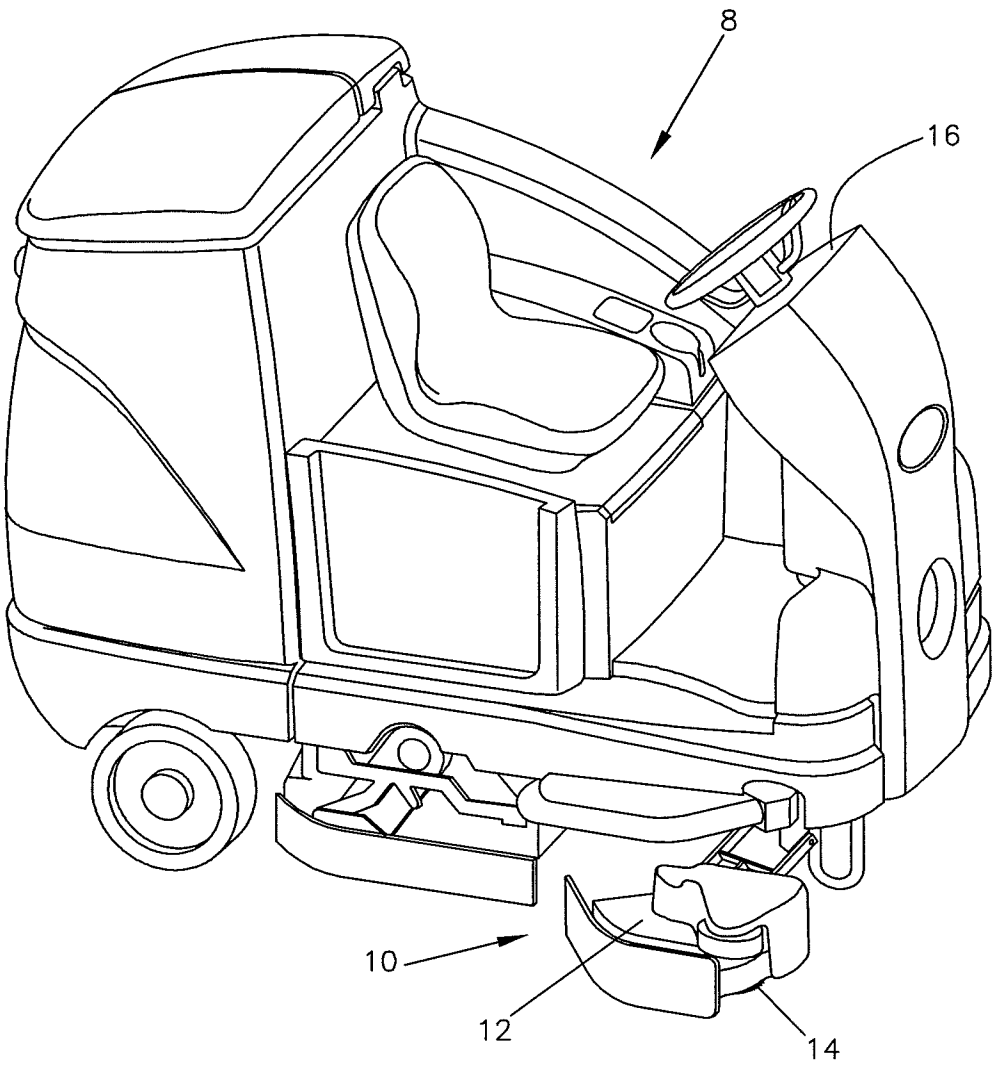
FIG. 1 is a perspective view of a floor maintenance machine incorporating a first embodiment of a side brush assembly of the present invention.

FIG. 1 illustrates a model T16 surface maintenance machine 8 manufactured by Tennant Company with a side brush assembly generally indicated as numeral 10. Side brush assembly 10 includes a brush deck 12 having an electric-powered floor brush 14 for engaging a floor surface during side brush assembly 10 operation. As detailed below, the side brush assembly 10 includes a mechanism for extending the side brush assembly 10 outwardly (away from a machine centerline) and for lowering brush 14 into floor surface contact. Activation of the mechanism is preferably achieved through a switch (not shown) accessible at the control panel, generally indicated by numeral 16.

Figure 2:
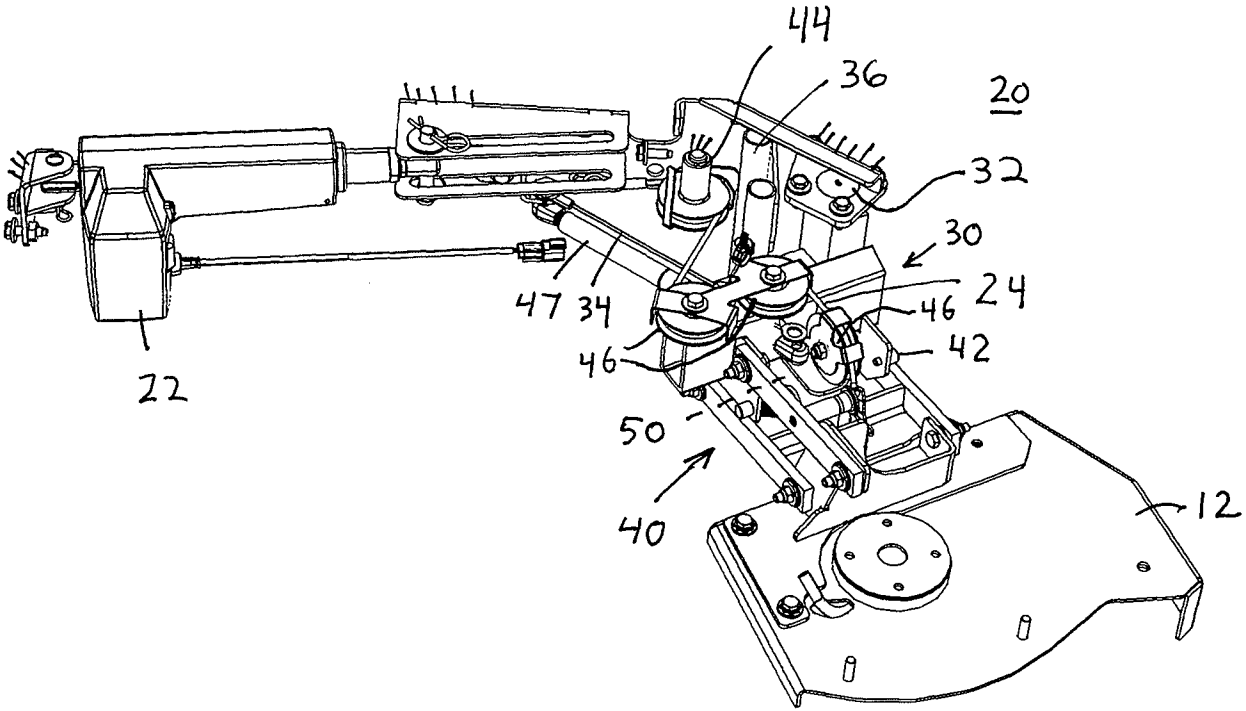
FIG. 2 illustrates the side brush assembly of FIG. 1 in a transport mode.

FIG. 2 is an isometric rendering of a side brush assembly mechanism 20 in the "up-and-in" mode, e.g., its storage and/or inactive transportation mode. Side brush assembly mechanism 20 includes linear actuator 22 which extends or retracts cable 24 which is routed throughout the lift/retract mechanism. One end of cable 24 is secured to the moving end of actuator 22 and the other end of cable 24 is secured to a linkage assembly as detailed below. Linear actuator 22 is preferably an electric linear actuator which is controlled via a switch. In other embodiments, linear actuator 22 may be hydraulic-based. In yet other embodiments, linear actuator 22 may be replaced with other cable tensioning devices, such as an electric winch, etc.

A pivot assembly 30 rotates relative to the machine frame to provide the in/out motion of brush deck 12. The pivot assembly 30 is connected to the machine frame via a pivot pin 32. Pivot assembly 30 operates between a range of positions with outward motion restrained by strap 34 and inward motion restrained by contact with instop 36.

Figure 20:
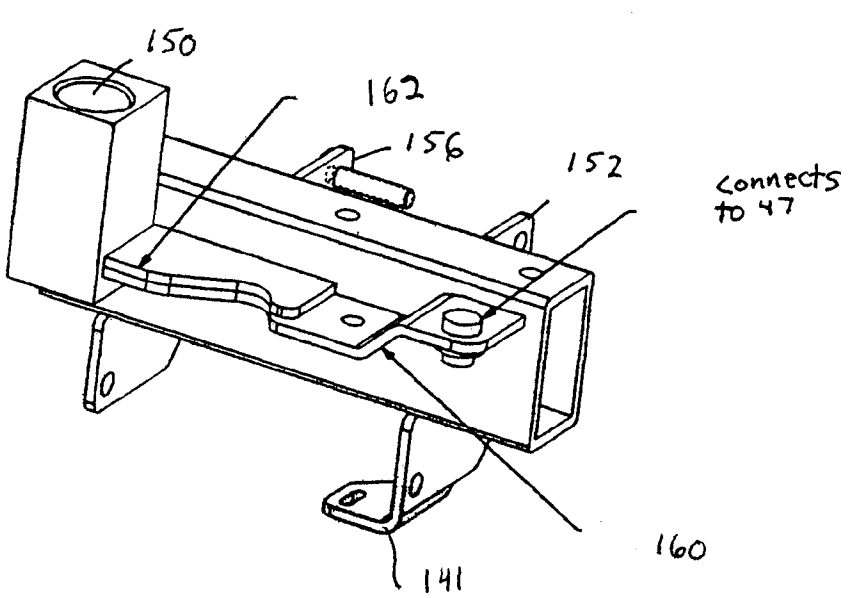
FIGS. 19-20 are perspective views of a pivot assembly of the side brush assembly of FIG. 1.
Figure 19:
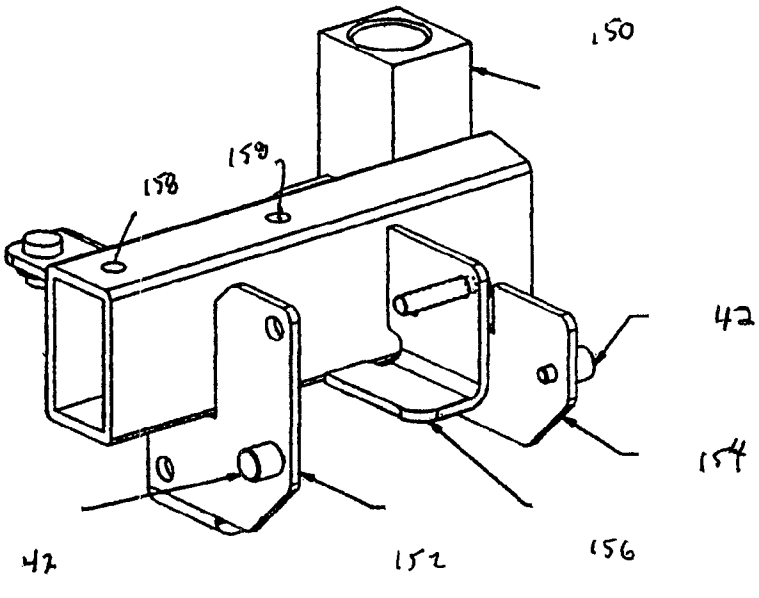

Extending from pivot assembly 30 is linkage assembly 40 which provides the up/down motion of the brush deck 12. The parallel geometry of linkage assembly 40 is important to keep brush deck 12 generally level as the deck 12 adjusts to floor contours. Linkage assembly 40 also operates between a range of positions with upstop pins 42, which are part of pivot assembly 30 as shown in FIGS. 19-20, defining an uppermost extent of travel of linkage assembly 40.

Figure 18:
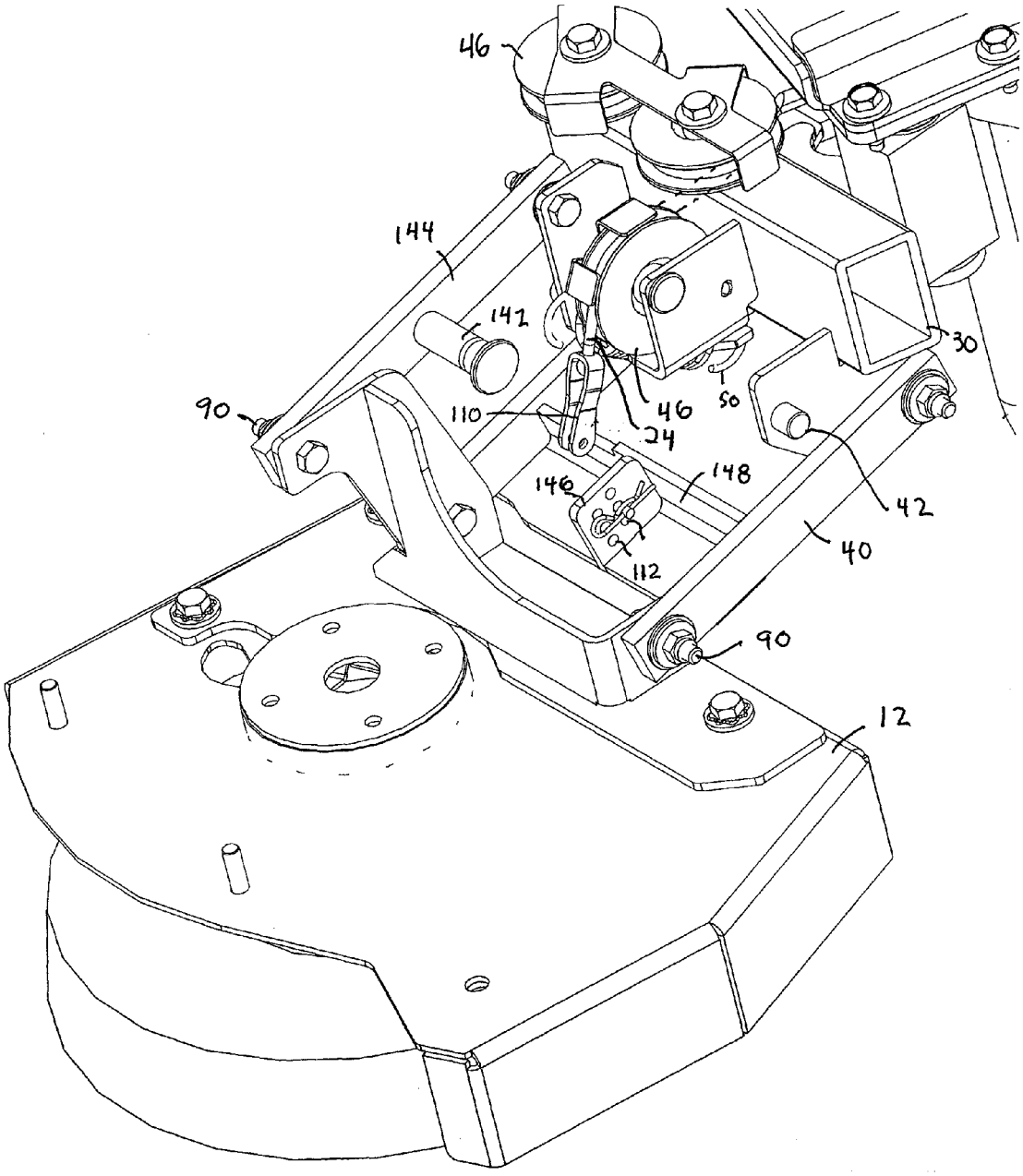
FIG. 18 is a perspective view of the side brush assembly of FIG. 1.

Cable 24 is routed from linear actuator 22 through pulleys 44, 46 and pivot assembly 30 and is terminated between lower links of linkage assembly 40 as shown in FIG. 18. Pulley 44 is attached to the machine frame, while pulleys 46 are attached to pivot assembly 30.

Pivot assembly 30 is biased outwardly by outforce spring 47 which is connected between pivot assembly 30 and the machine frame. Outforce spring 47 provides a biasing force tending to extend brush deck 12 away from the machine centerline. Outforce spring 47 is a gas-charged spring assembly. Again, strap 34 limits the extent to which pivot assembly 30 rotates outwardly.

Brush deck 12 is biased downwardly by downforce spring 50 which connects between the pivot assembly 30 and linkage assembly 40. Mass of the brush deck 12 also contributes a downward force tending to lower the scrub brush into floor contact. Depending on the mass of the brush deck 12, downforce spring 50 may not be necessary.

In the "up-and-in" mode of FIG. 2, cable 24 and linear actuator 22 resist the down force of spring 50, the out force of spring 47 and gravity force of brush deck 12 and linkage assembly 40, and function to restrain pivot assembly 30 in contact with instop 36 and restrain linkage assembly 40 in contact with upstop pins 42. To lower/extend the brush deck 12, actuator 22 is activated into an extension mode, via for example a switch, and the pivot assembly 30 moves away from instop 36 and the linkage assembly 40 descends away from contact with upstop pins 42 toward ground contact.

Figure 3:
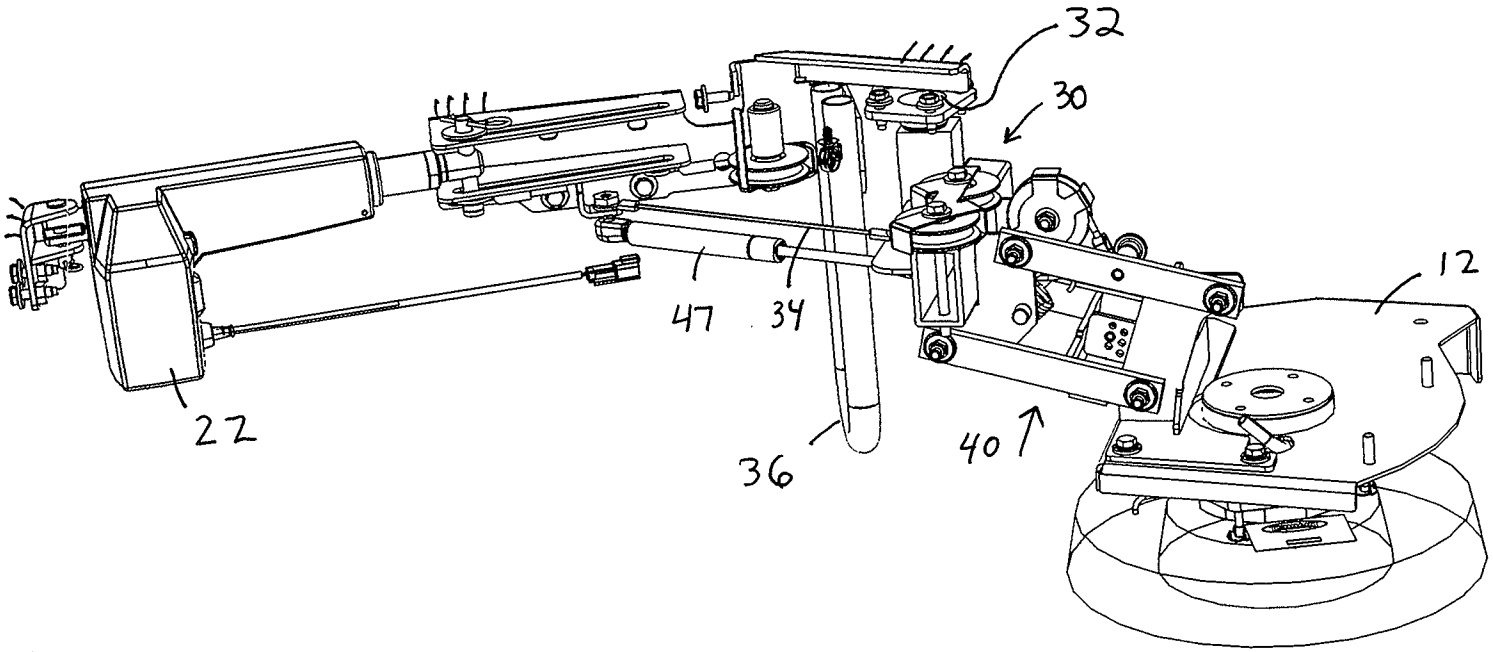
FIG. 3 illustrates the side brush assembly of FIG. 1 in an operational mode.

FIG. 3 is an isometric rendering of the side brush assembly mechanism in the "down-and-out" mode, e.g., operational mode. As actuator 22 is extended, pivot assembly 30 pivots about pivot pin 32 to move away from instop 36 and linkage assembly 40 moves to lower brush deck 12 into floor contact. In this orientation of the side brush assembly mechanism 20, the cable 24 (not shown) is slack.

Figure 4:
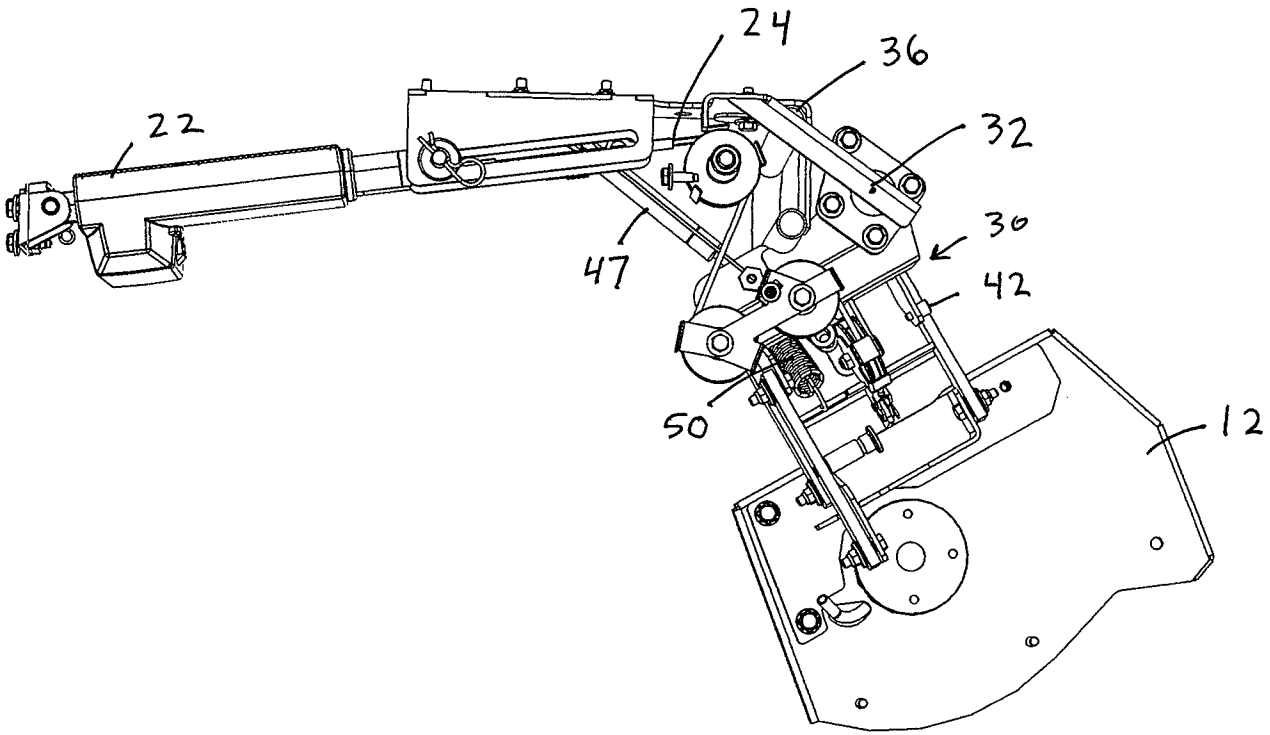
FIG. 4 is a top plan view of the side brush assembly of FIG. 2.

FIG. 4 is a top-down rendering of the side brush assembly mechanism in the "up-and-in" mode, such as shown in FIG. 2.

Figure 5:
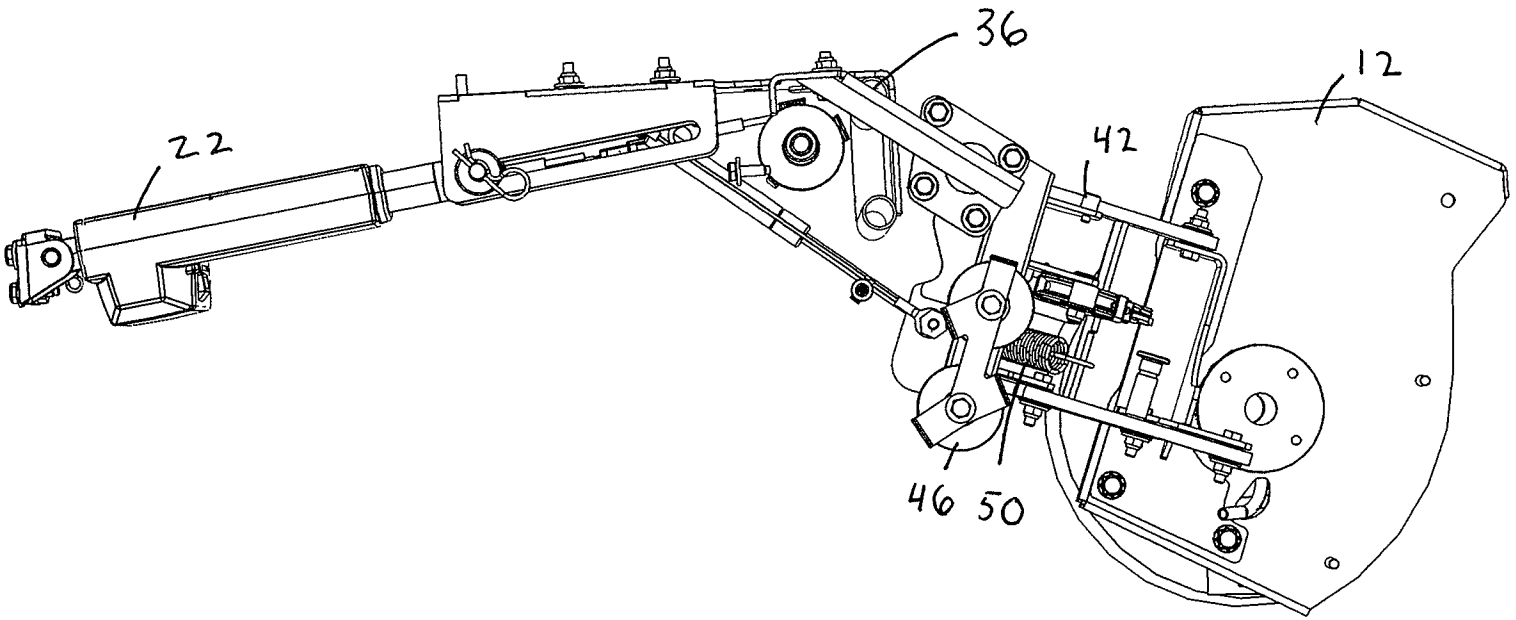
FIG. 5 is a top plan view of the side brush assembly of FIG. 3.

FIG. 5 is a top-down rendering of the side brush assembly mechanism in the "down-and-out" mode, such as shown in FIG. 3. In this orientation, cable 24 (not shown) is slack.

Figure 6:
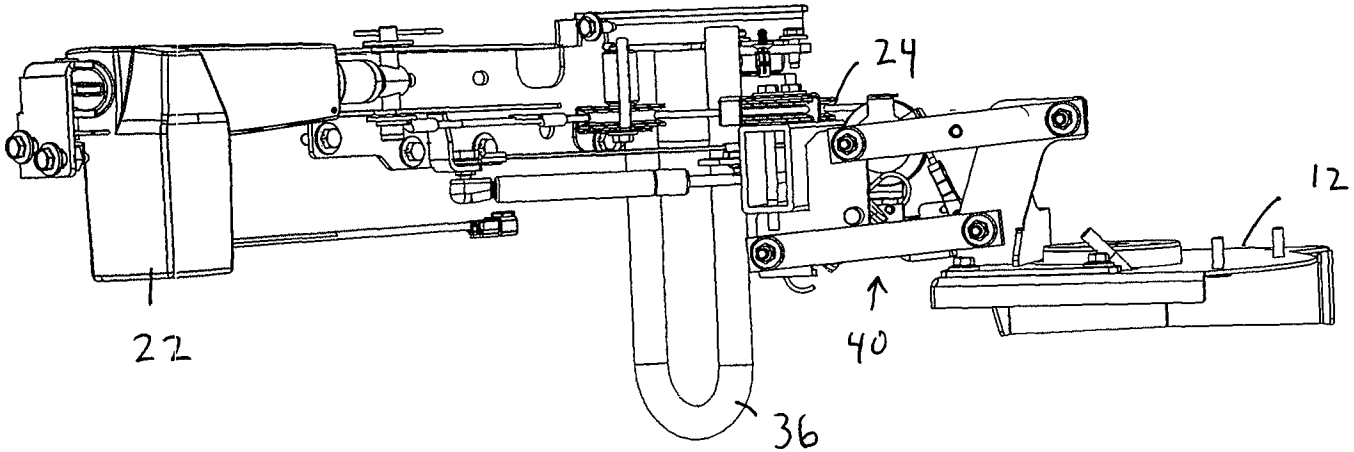
FIG. 6 is a side view of the side brush assembly of FIG. 2.
Figure 7:
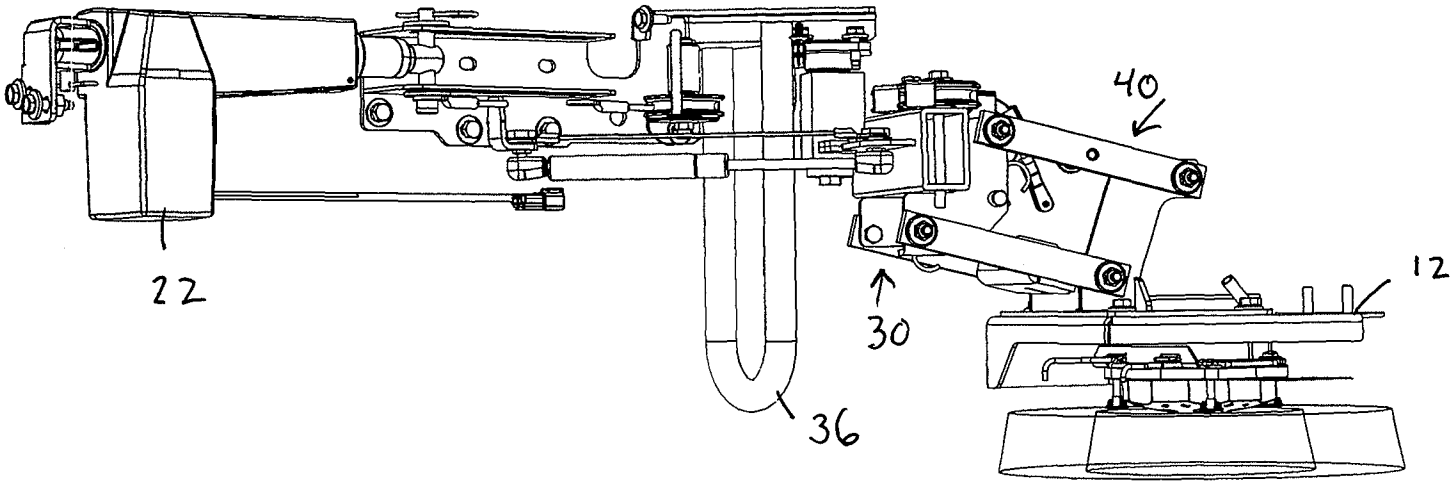
FIG. 7 is a side view of the side brush assembly of FIG. 3.

FIGS. 6-7 are side view renderings of the parallel arm linkage of linkage assembly 40. These figures illustrate that brush deck 12 is maintained generally parallel to the floor. FIG. 6 shows the mechanism in an "up-and-in" mode, such as shown in FIG. 2. In this mode, cable 24 holds the brush deck 12 off the floor surface. FIG. 7 shows the side brush mechanism in the "down-and-out" operational mode. With actuator 22 extended, the cable 24 is slack, allowing the spring 50 (shown more clearly in FIG. 8) to push the brush deck 12 into the floor surface.

Figure 8:
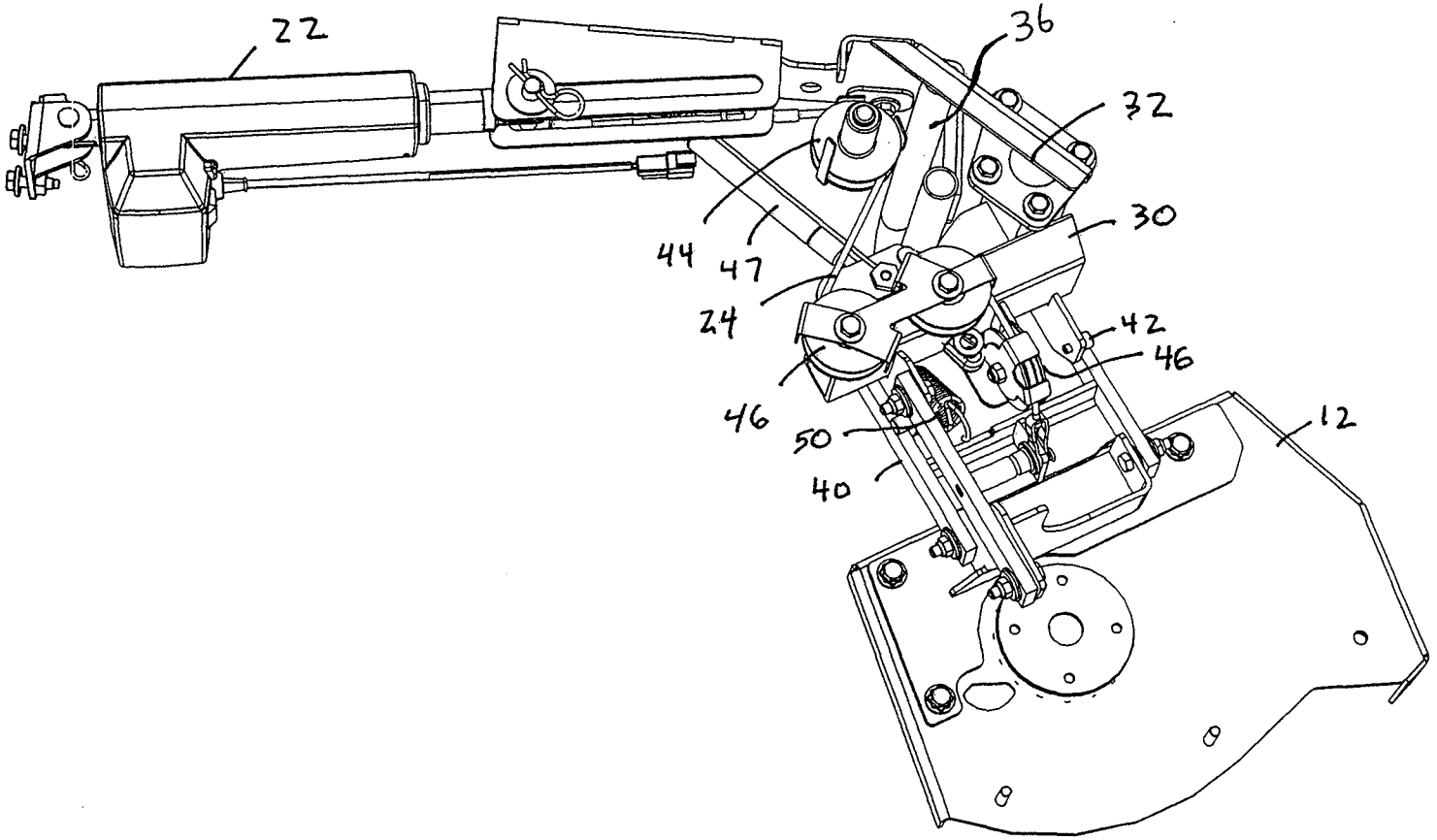
FIG. 8 is a perspective view of the side brush assembly of FIG. 2.

FIG. 8 is a perspective illustration of the side brush assembly mechanism in an "up and in" configuration. Contact is made between linkage assembly 40 and upstop pin 42 and between pivot assembly 30 and instop 36.

Figure 9:
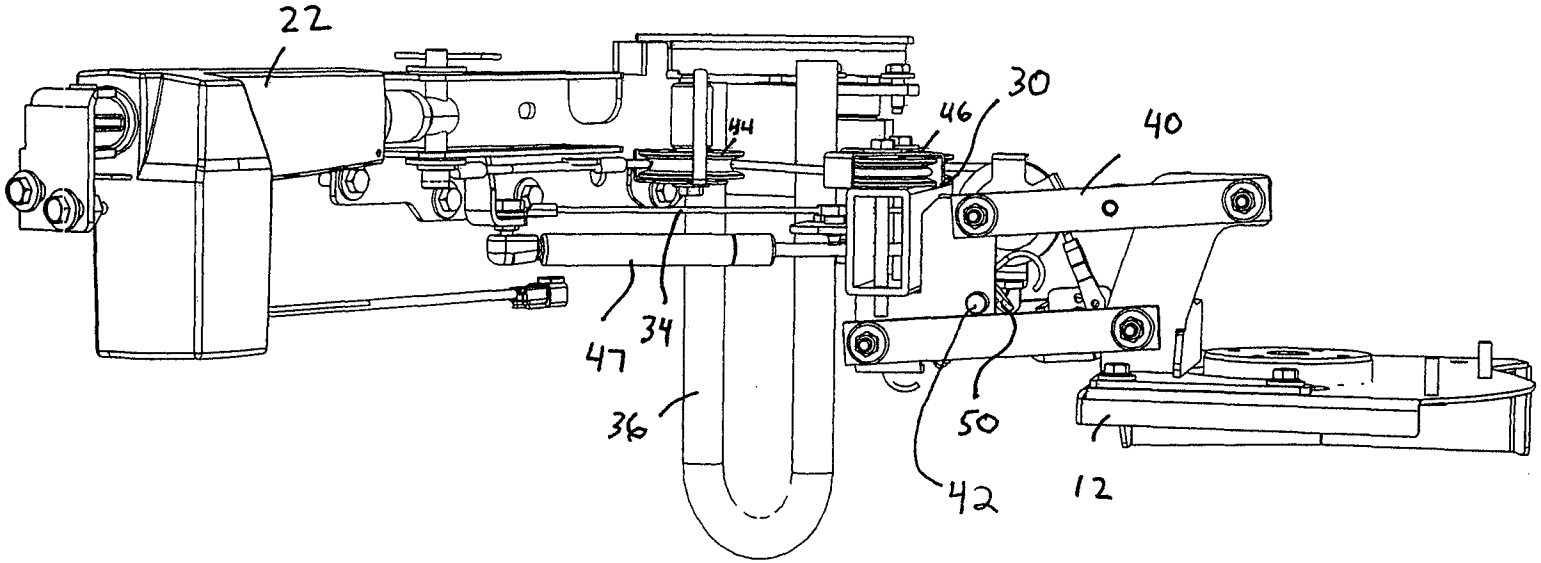
FIG. 9 is a side view of the side brush assembly of FIG. 8.

FIG. 9 is a perspective illustration of the side brush assembly mechanism in an "up and in" configuration. As shown, contact is made between a lower link of linkage assembly 40 and pin 42.

Figure 10:
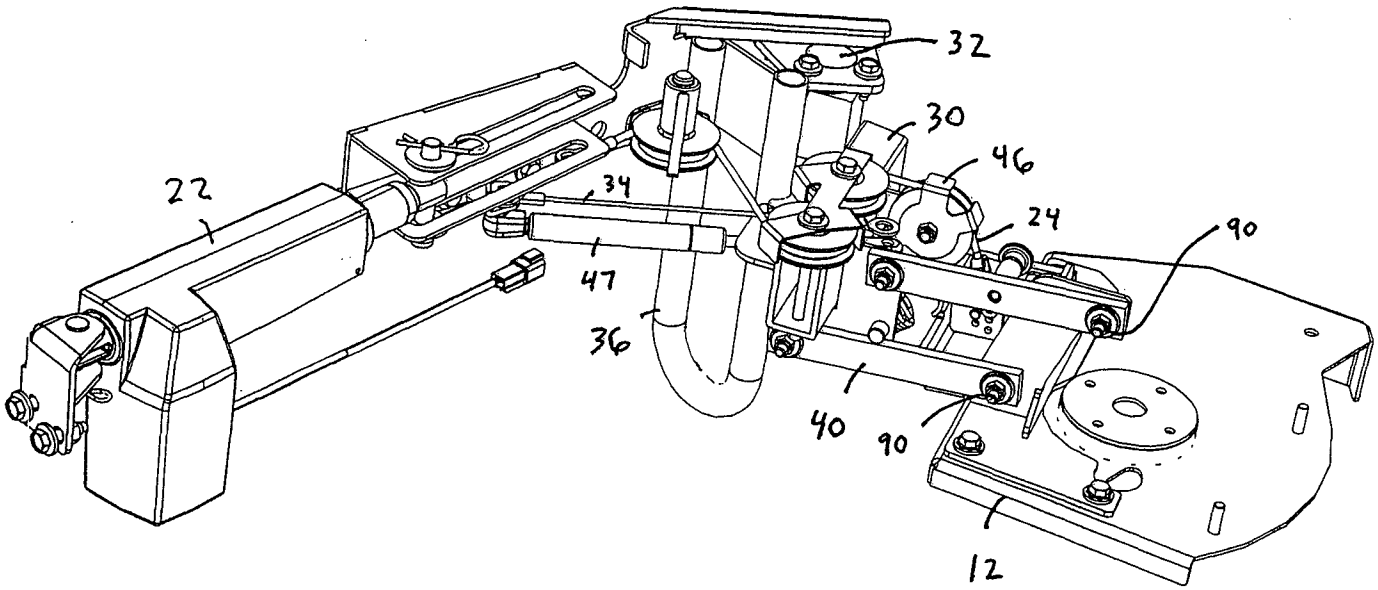
FIG. 10 is a perspective view of the side brush assembly of FIG. 8.

FIG. 10 is a perspective illustration of the side brush assembly mechanism in an "up and in" configuration. Brush deck 12 is movably coupled to linkage assembly 40 via pivot fasteners 90.

Figure 11:
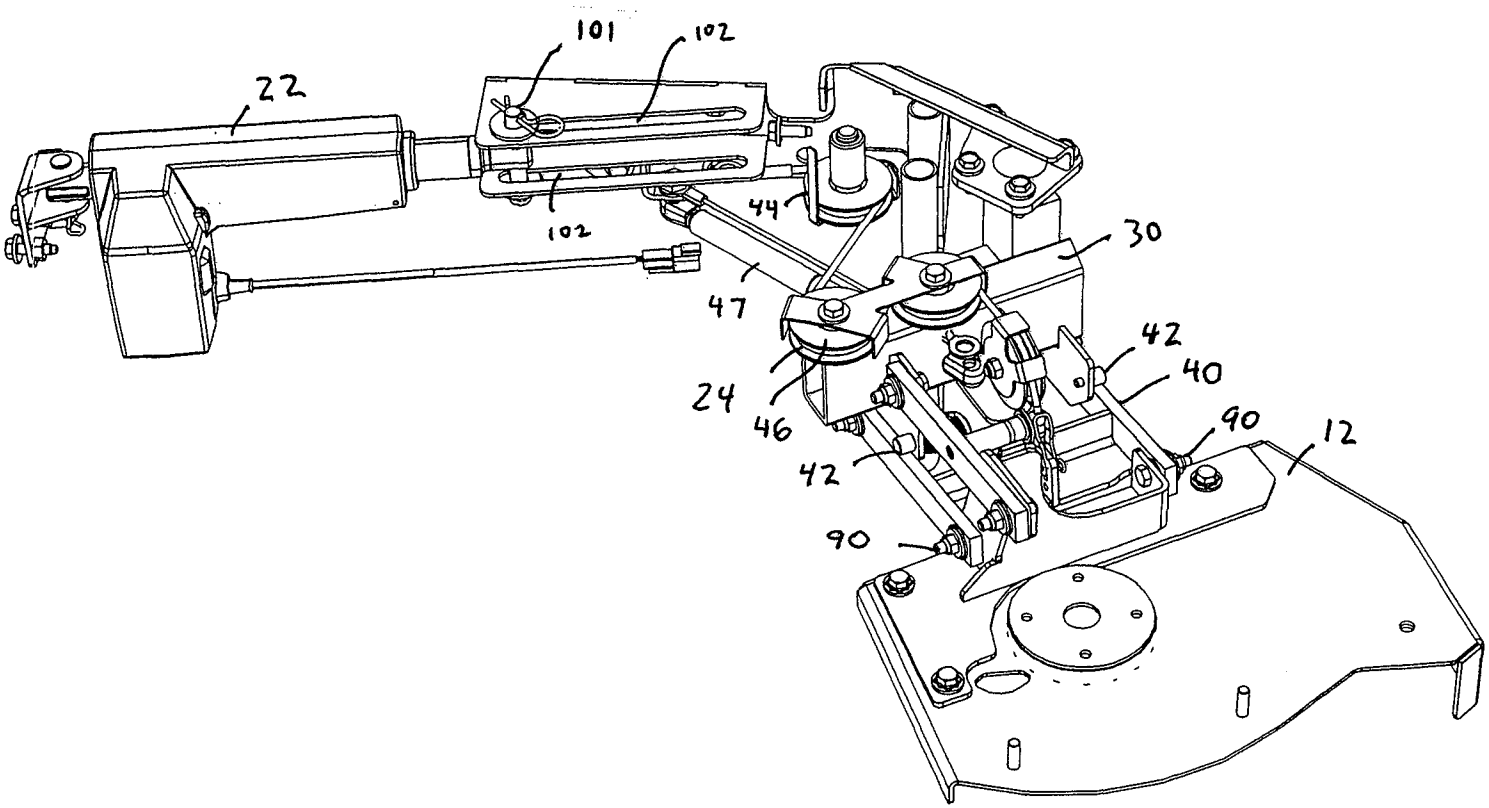
FIG. 11 is a perspective view of the side brush assembly of FIG. 8.

FIG. 11 is a perspective illustration of the side brush assembly mechanism in an "up and in" configuration, with linear actuator 22 fully retracted. Movement of the movable end of linear actuator 22 is constrained via pin 101 traveling within a pair of elongated slots 102. In a preferred embodiment, when the linear actuator is fully extended the cable 24 is slack.

Figure 12:
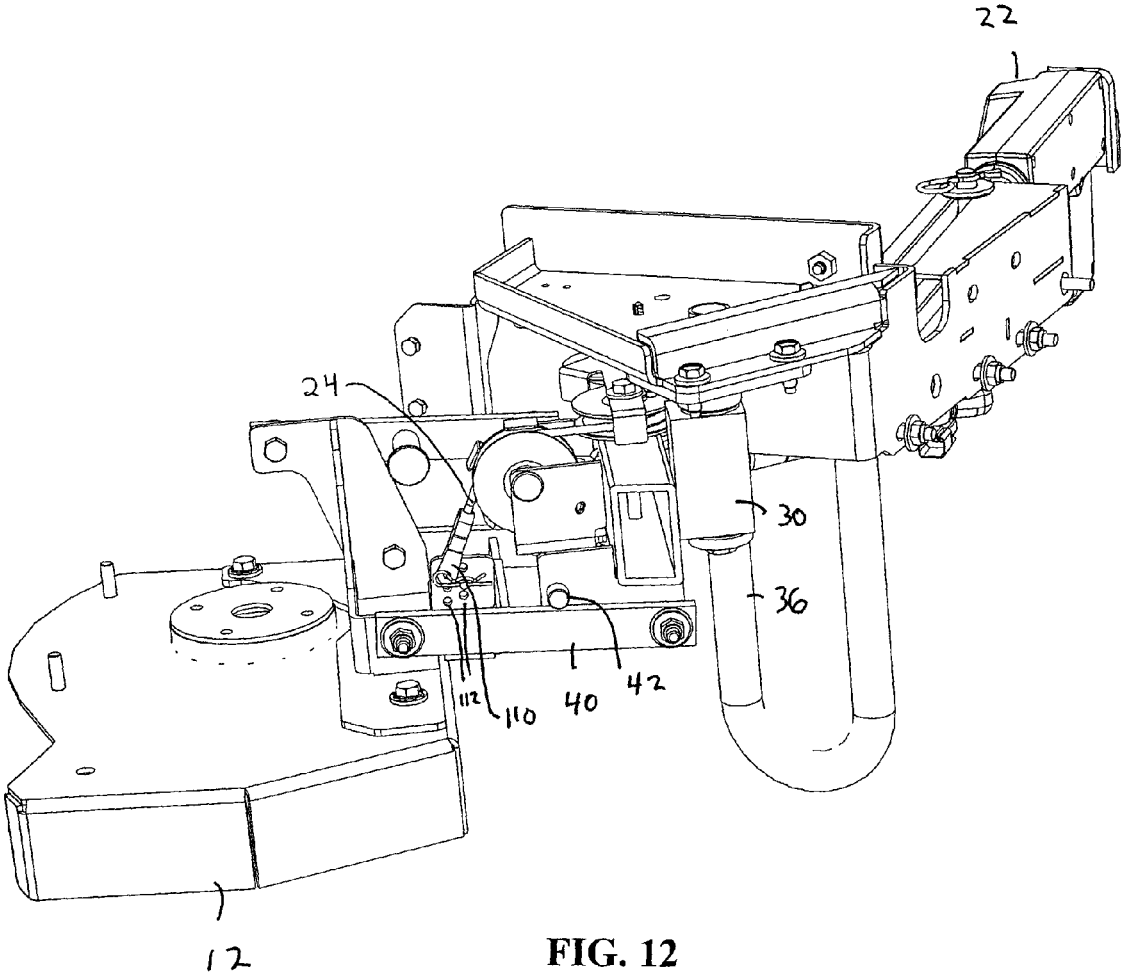
FIG. 12 is a perspective view of the side brush assembly of FIG. 8.

FIG. 12 is a perspective illustration of the side brush assembly mechanism in an "up and in" configuration. Cable 24 is connected to linkage assembly 40 via connector 110. A pin of connector 110 can be adjusted between a plurality of apertures 112 to control precise positioning of the brush deck 12.

Figure 14:
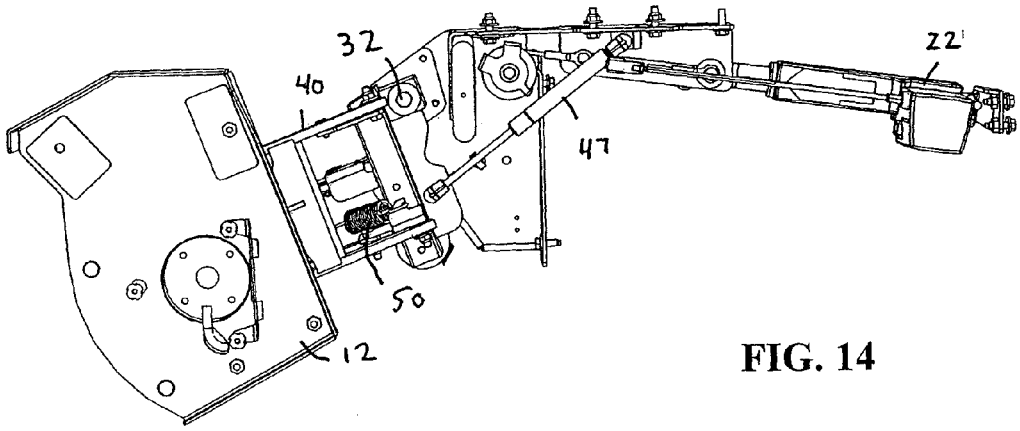
FIG. 14 is a bottom plan view of the side brush assembly of FIG. 1 shown in an operational mode.
Figure 13:
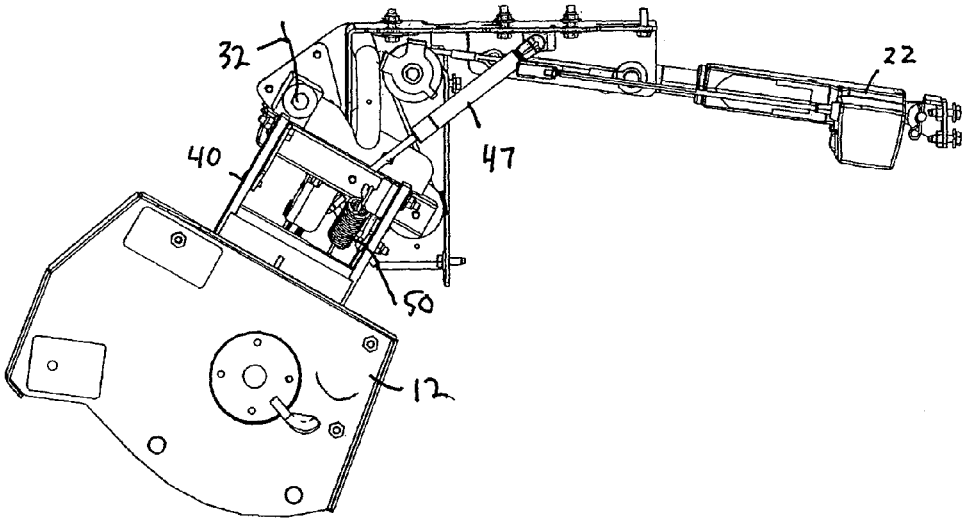
FIG. 13 is a bottom plan view of the side brush assembly of FIG. 1 shown in a transport mode.

FIGS. 13-14 are bottom views of the side brush assembly mechanisms providing a comparison between the "up and in" position (FIG. 13) and the "down and out" position (FIG. 14).

Figure 15:
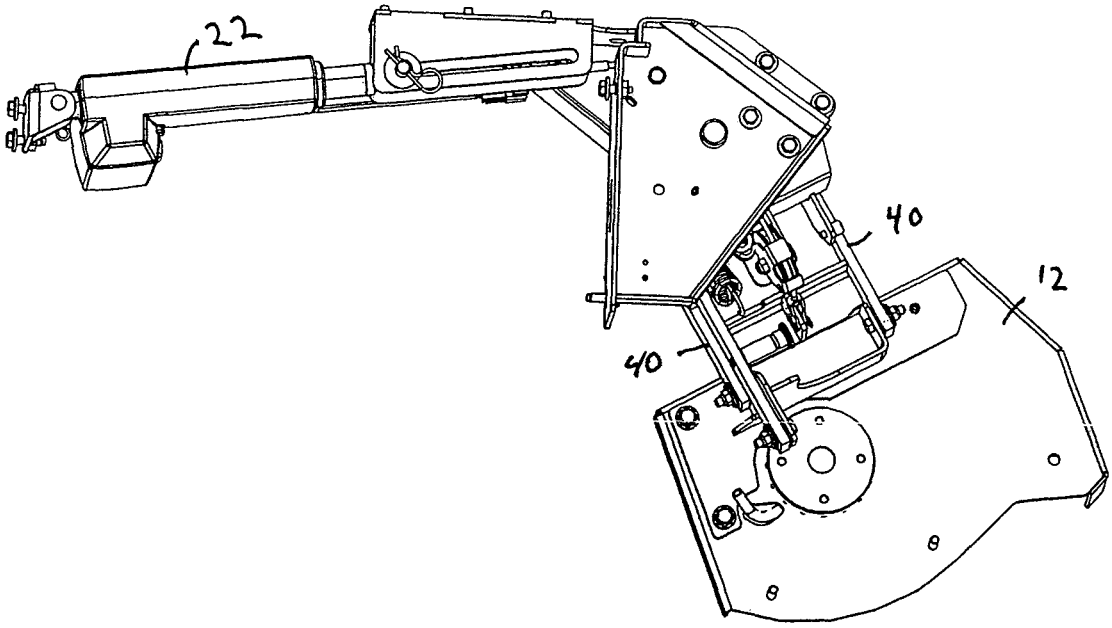
FIG. 15 is a top plan view of the side brush assembly of FIG. 1 shown in a transport mode.
Figure 16:
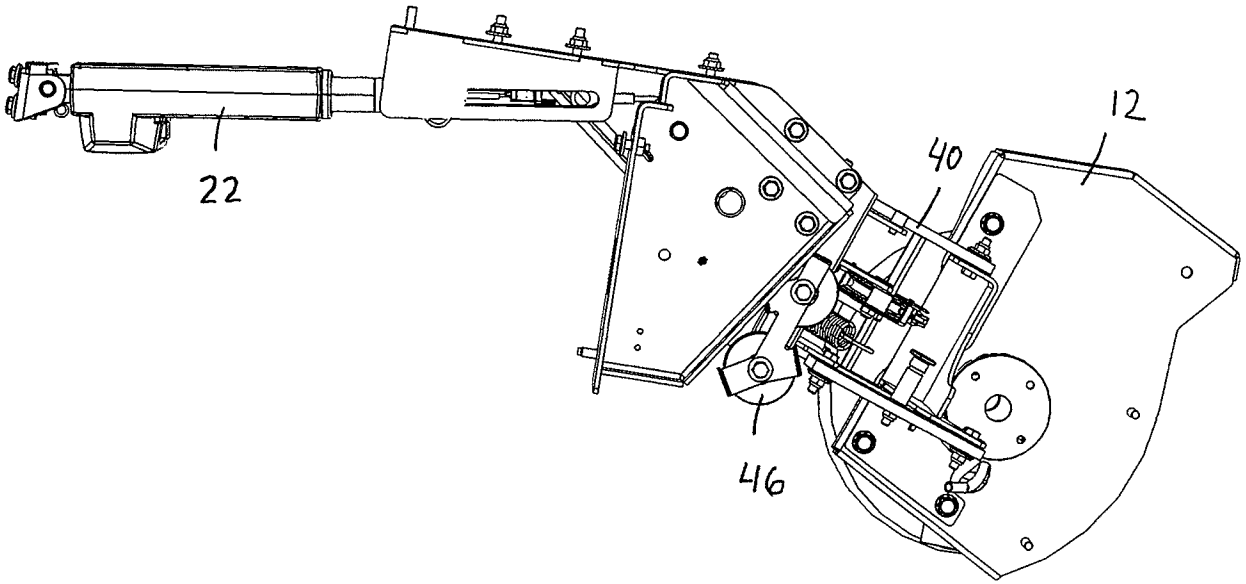
FIG. 16 is a top plan view of the side brush assembly of FIG. 1 shown in an operational mode.

FIGS. 15-16 are top views of the side brush assembly mechanisms providing a comparison between the "up and in" position (FIG. 15) and the "down and out" position (FIG. 16).

Figure 17:
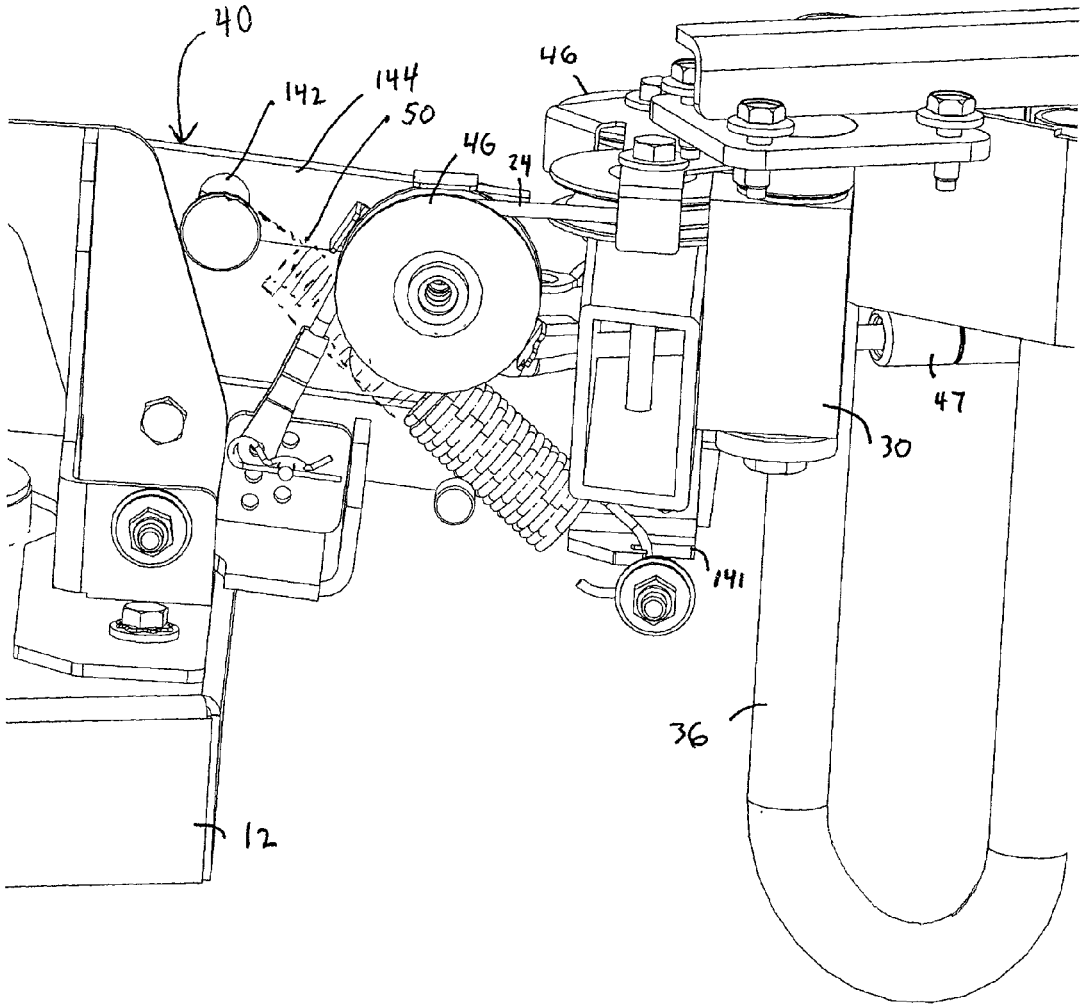
FIG. 17 is a detailed view of the side brush assembly of FIG. 1.

FIG. 17 is a close-up view of pivot assembly 30 and linkage assembly 40. The downforce spring 50 is connected at one end to extension 141 of pivot assembly 30 and at the other end to spring pin 142. Spring pin 142 is connected to an upper link 144 of linkage assembly 40.

FIG. 18 is a view of the pivot assembly showing connector 110 detached from linkage assembly 40 and spring 50 detached from spring pin 142. Apertures 112 are defined upon an extension 146 extending from plate connector 148. Plate connector 148 is generally L-shaped and rigidly secures together the pair of lower links of linkage assembly 40.

FIGS. 19 and 20 are perspective illustrations of a main frame of pivot assembly 30. The frame includes a pivot pin receptacle 150 through which pivot pin 32 is received. One or more bearings are provided between pin 32 and the pin receptacle to provide smooth rotation of pivot assembly 30 relative to the machine frame.

One end of spring 50 is connected to extension 141. Links of the linkage assembly 40 are connected at arm extensions 152, 154. One pulley 46 is connected at pulley sheave 156. Two other pulleys 46 are secured to pivot assembly 30 at apertures 158. A strike plate 162 engages instop 36, for example when cable 24 is retracted.

Benefits of the side brush assembly mechanism of the present invention include: 1) a reduction in part count compared to existing designs; 2) improved packaging flexibility due to small size; 3) cost savings; and 4) relative simplicity, which leads to increased reliability.

Although the present invention and its advantages have been described in detail, it should be understood that various changes, substitutions and alterations can be made herein without departing from the spirit and scope of the invention as defined by the appended claims. Moreover, the scope of the present application is not intended to be limited to the particular embodiments of the process, machine, manufacture, composition of matter, means, methods and steps described in the specification. As one of ordinary skill in the art will readily appreciate from the disclosure of the present invention, processes, machines, manufacture, compositions of matter, means, methods, or steps, presently existing or later to be developed that perform substantially the same function or achieve substantially the same result as the corresponding embodiments described herein may be utilized according to the present invention. Accordingly, the appended claims are intended to include within their scope such processes, machines, manufacture, compositions of matter, means, methods, or steps.

The invention claimed is:

1. A side brush assembly mechanism for a floor surface maintenance machine comprising:

a brush deck carrying a floor-engaging brush;

a linkage assembly supporting the brush deck above the floor surface;

a pivot assembly connected to a machine frame and adapted to rotate the brush deck and linkage assembly about a pivot pin, said pivot pin being generally vertical relative to the floor surface, with the pivot assembly adapted to swing the brush deck about the pivot pin either toward or away from a machine centerline;

a cable connected at one end to the linkage assembly;

a downforce spring connected at one end to a link of the linkage assembly, said downforce spring for biasing the brush deck downwardly toward the floor surface; and a selectively controlled cable tensioning device attached to a machine frame away from the linkage assembly and the pivot assembly, said cable tensioning device for retracting the cable during use of the machine to both raise and retract the brush deck, wherein upon activation by an operator the cable tensioning device provides a tension force on the cable tending to both lift the brush deck away from the floor surface and swing the brush deck about the pivot pin toward the machine centerline and extend the downforce spring, and when the tension force is decreased the brush deck swings about the pivot pin away from the machine centerline and lowers into contact with the floor surface and the downforce spring retracts causing the linkage assembly to pivot the brush deck toward the floor surface.

2. The side brush assembly mechanism of claim 1 wherein the linkage assembly includes a parallel arm lift linkage.

3. The side brush assembly mechanism of claim 2 wherein the parallel arm lift linkage maintains the brush deck generally parallel to a floor surface during machine operation.

4. The side brush assembly mechanism of claim 1 wherein the pivot assembly is outwardly biased by a biasing device.

5. The side brush assembly mechanism of claim 4 wherein the biasing device is a gas-charged spring.

6. The side brush assembly mechanism of claim 1 wherein the downforce spring is connected at one end to the pivot assembly and to a spring pin attached to the link of the linkage assembly at the other end.

7. The side brush assembly mechanism of claim 1 wherein the pivot assembly is limited to an outermost position by a restraining strap.

8. The side brush assembly mechanism of claim 1 wherein the pivot assembly is limited to an innermost position by an instop.

9. The side brush assembly mechanism of claim 1 wherein the cable tensioning device is a linear actuator.

10. The side brush assembly mechanism of claim 9 wherein the linear actuator provides a tension force on the cable tending to lift and retract the pivot assembly, linkage assembly and brush deck.

11. The side brush assembly mechanism of claim 1 wherein the cable is routed through a plurality of pulleys.

12. The side brush assembly mechanism of claim 11 wherein at least a pair of pulleys are mounted on the pivot assembly in generally horizontal orientation relative to the ground surface and one of the pulleys is mounted to the pivot assembly in a generally vertical orientation.

13. A side brush assembly mechanism for a floor surface maintenance machine comprising:

a pivot assembly adapted to pivot away from a machine centerline;

a linkage assembly connected to the pivot assembly;

a brush deck connected to the linkage assembly;

a downforce spring connected to the linkage assembly, said downforce spring providing a downward bias force tending to move the brush deck toward contact with the floor surface; and a cable connected at one end to the linkage assembly and connected to a selectively controlled tensioning device at the other end, said tensioning device being connected to a machine frame away from the pivot assembly and linkage assembly, wherein application of a tension on the cable by the tensioning device causes the pivot assembly to retract toward the machine centerline about a generally vertical pivot pin and causes the linkage assembly to lift the brush deck away from a floor surface and causes the downforce spring to extend, and wherein upon a decrease in tension on the cable the pivot assembly pivots about the pivot pin away from the machine centerline and the downforce spring retracts and the linkage assembly lowers the brush deck into contact with the floor surface.

14. The side brush assembly mechanism of claim 13 wherein the pivot assembly rotates about a pivot pin attached to a frame of the machine.

15. The side brush assembly mechanism of claim 13 wherein the pivot assembly includes a parallel arm linkage adapted to maintain the brush deck in a generally horizontal manner as the brush deck adapts to floor surface contours.

16. The side brush assembly mechanism of claim 15 wherein the cable is routed through a plurality of pulleys.

17. The side brush assembly mechanism of claim 13 wherein the tensioning device is a linear actuator.

18. The side brush assembly mechanism of claim 13 further comprising: a plurality of biasing springs.

19. The side brush assembly mechanism of claim 18 wherein one of the biasing springs acts on the pivot assembly to provide an out force tending to pivot the pivot assembly outwardly away from the machine centerline.

20. A side brush assembly mechanism for a floor surface maintenance machine comprising:

a brush deck carrying a floor-engaging brush;

a linkage assembly supporting the brush deck above the floor surface;

a pivot assembly connected to a machine frame and adapted to rotate the brush deck and linkage assembly about a generally vertical pivot pin, with the pivot assembly adapted to swing the brush deck about the pivot pin either toward or away from a machine centerline;

a cable and at least one pulley operatively connected to the linkage assembly and brush deck;

a downforce spring connected to the linkage assembly and biasing the brush deck toward contact with the floor surface; and a cable tensioning device attached to a machine frame away from the linkage assembly and the pivot assembly, said cable tensioning device for retracting the cable during use of the machine to both raise and retract the brush deck, wherein upon activation by an operator the cable tensioning device provides a tension force on the cable tending to both lift the brush deck away from the floor surface and swing the brush deck about the pivot pin toward the machine centerline and extend the downforce spring, and when the tension force is decreased the brush deck swings about the pivot pin away from the machine centerline and the downforce spring retracts and lowers the brush into contact with the floor surface.

21. The side brush assembly mechanism of claim 20 wherein the pivot assembly includes a parallel arm linkage adapted to maintain the brush deck in a generally horizontal manner as the brush deck adapts to floor surface contours.

* * * * *